US011262108B2

(12) United States Patent
Morimoto

(10) Patent No.: US 11,262,108 B2
(45) Date of Patent: Mar. 1, 2022

(54) REFRIGERATION CYCLE APPARATUS

(71) Applicant: Mitsubishi Electric Corporation, Tokyo (JP)

(72) Inventor: Kota Morimoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 114 days.

(21) Appl. No.: 16/637,381

(22) PCT Filed: Oct. 10, 2017

(86) PCT No.: PCT/JP2017/036629
§ 371 (c)(1),
(2) Date: Feb. 7, 2020

(87) PCT Pub. No.: WO2019/073514
PCT Pub. Date: Apr. 18, 2019

(65) Prior Publication Data
US 2020/0240679 A1 Jul. 30, 2020

(51) Int. Cl.
*F25B 13/00* (2006.01)
*F25B 49/02* (2006.01)

(52) U.S. Cl.
CPC ..... *F25B 13/00* (2013.01); *F25B 49/022* (2013.01); *F25B 2313/0233* (2013.01);
(Continued)

(58) Field of Classification Search
CPC ..... F25B 13/00; F25B 2313/0233; F25B 2313/02741; F25B 2313/0294;
(Continued)

(56) References Cited

U.S. PATENT DOCUMENTS 4,308,042 A * 12/1981 Ecker ..... F24D 11/0221 62/82
2009/0230202 A1* 9/2009 Matsui ..... F24F 11/0008 236/44 A (Continued)

FOREIGN PATENT DOCUMENTS

JP H05-164382 A 6/1993
JP 2002-054834 A 2/2002

(Continued)

OTHER PUBLICATIONS

International Search Report of the International Searching Authority dated Dec. 19, 2017 in corresponding International Patent Application No. PCT/JP2017/036629 (and English translation).

*Primary Examiner* — Henry T Crenshaw
(74) *Attorney, Agent, or Firm* — Posz Law Group, PLC

(57) ABSTRACT

A refrigeration cycle apparatus includes a refrigerant circuit that is formed by connecting a compressor, a flow passage switching device, an outdoor heat exchanger, an expansion unit, and an indoor heat exchanger via pipes, and through which refrigerant flows, an outdoor air-sending device configured to blow outdoor air to the outdoor heat exchanger, an outdoor air temperature detector configured to detect a temperature of the outdoor air, and a controller configured to control an operation of the outdoor air-sending device.

9 Claims, 3 Drawing Sheets

(52) U.S. Cl.
CPC ..... *F25B 2313/0294* (2013.01); *F25B 2313/02741* (2013.01); *F25B 2313/0315* (2013.01); *F25B 2700/2106* (2013.01)

(58) Field of Classification Search
CPC ..... F25B 2313/0315; F25B 2700/2106; F25B 49/022
See application file for complete search history.

(56) References Cited

U.S. PATENT DOCUMENTS

| | | | | |
|---|---|---|---|---|
| 2010/0170273 | A1* | 7/2010 | Morimoto | B01D 53/265 62/176.6 |
| 2012/0255318 | A1* | 10/2012 | Kido | F25B 31/006 62/126 |
| 2016/0084554 | A1* | 3/2016 | Suzuki | F25B 13/00 62/160 |
| 2016/0238271 | A1 | 8/2016 | Kimura et al. | |

FOREIGN PATENT DOCUMENTS

| | | | |
|---|---|---|---|
| JP | 2015-068596 | A | 4/2015 |
| JP | 2015068596 | * | 4/2015 |
| JP | 2015-113993 | A | 6/2015 |

* cited by examiner

REFRIGERATION CYCLE APPARATUS

CROSS REFERENCE TO RELATED APPLICATION

This application is a U.S. national stage application of PCT/JP2017/036629 filed on Oct. 10, 2017, the contents of which are incorporated herein by reference.

TECHNICAL FIELD

The present invention relates to a refrigeration cycle apparatus that prevents frequent shifting to a defrosting operation.

BACKGROUND ART

There has been known a refrigeration cycle apparatus that performs a defrosting operation. In the defrosting operation, a flow passage switching device switches a flow passage of refrigerant during a heating operation so that refrigerant flows temporarily in the same flow path as that during a cooling operation, and high-temperature refrigerant flows in an outdoor heat exchanger, thereby melting the frost on the outdoor heat exchanger. However, shifting to the defrosting operation causes noticeable noise, therefore leading to complaints. Thus, there has been proposed an air-conditioning device that prevents frequent shifting to the defrosting operation (for example, see Patent Literature 1). Patent Literature 1 discloses an air-conditioning device that sets a first threshold pressure to an evaporating pressure value to prevent an evaporating temperature of the outdoor heat exchanger from becoming equal to or less than 0 degrees C., and controls a rotation speed of an outdoor air-sending device within a range of pre-stored constant values in the table.

CITATION LIST

Patent Literature

Patent Literature 1: Japanese Unexamined Patent Application Publication No. 2015-68596

SUMMARY OF INVENTION

Technical Problem

However, in the air-conditioning device disclosed in Patent Literature 1, the first threshold pressure of the evaporating pressure value by which the evaporating temperature does not become equal to or less than 0 degrees C. is constant regardless of the dew-point temperature. Here, the dew-point temperature varies according to humidity of outdoor air. Thus, when the dew-point temperature changes, it has not been possible to prevent depositing of frost on the outdoor heat exchanger from being frosted, and therefore the operation may be shifted to the defrosting operation.

The present invention has been made to overcome the above problem, and an object of the present invention is to provide a refrigeration cycle apparatus that prevents frequent shifting to a defrosting operation.

Solution to Problem

A refrigeration cycle apparatus according to an embodiment of the present invention includes a refrigerant circuit that is formed by connecting a compressor, a flow passage switching device, an outdoor heat exchanger, an expansion unit, and an indoor heat exchanger via pipes, and through which refrigerant flows; an outdoor air-sending device configured to blow outdoor air to the outdoor heat exchanger; an outdoor air temperature detector configured to detect a temperature of the outdoor air; and a controller configured to control an operation of the outdoor air-sending device, the controller including: a dew-point temperature prediction unit configured to predict a dew-point temperature to be observed after elapse of a preset time, based on an outdoor air temperature detected by the outdoor air temperature detector; an evaporating temperature prediction unit configured to predict an evaporating temperature to be observed after elapse of a preset time of the refrigerant flowing in the outdoor heat exchanger during a heating operation; and an air-sending control unit configured to change a rotation speed of the outdoor air-sending device in such a manner that the evaporating temperature predicted by the evaporating temperature prediction unit exceeds the dew-point temperature predicted by the dew-point temperature prediction unit.

Advantageous Effects of Invention

According to an embodiment of the present invention, the air-sending control unit changes a rotation speed of the outdoor air-sending device in such a manner that the predicted evaporating temperature to be observed after elapse of a preset time exceeds the predicted dew-point temperature to be observed after elapse of the preset time based on an outdoor air temperature. Thus, the air-sending control unit changes the rotation speed of the outdoor air-sending device according to the dew-point temperature that is changed based on the outdoor air temperature. Therefore, even if the dew-point temperature is changed, the frost can be prevented from being deposited on the outdoor heat exchanger. Accordingly, the refrigeration cycle apparatus can prevent frequent shifting to the defrosting operation.

DESCRIPTION OF EMBODIMENT

Embodiment 1

Figure 1:
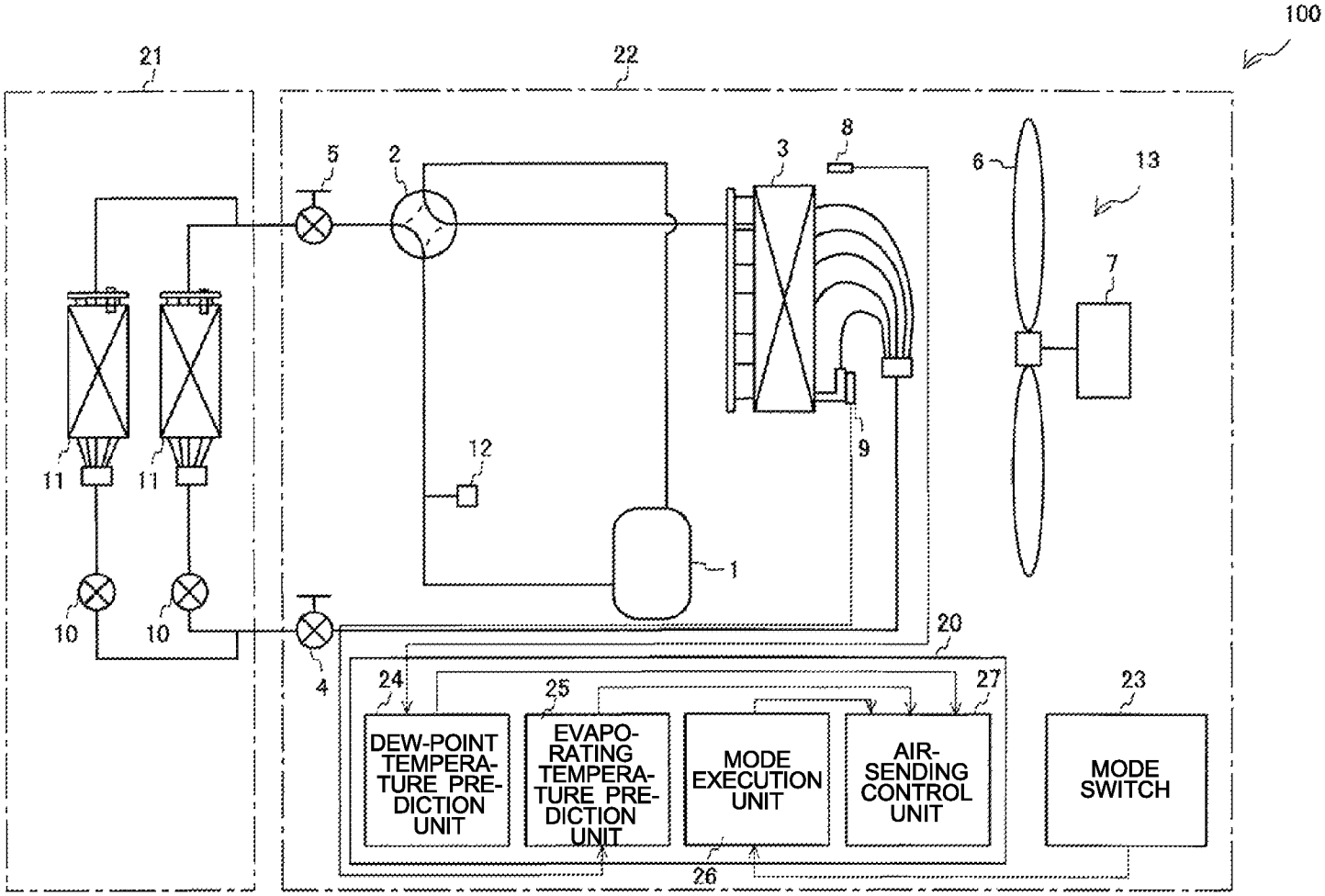
FIG. 1 is a circuit diagram illustrating a refrigeration cycle apparatus 100 according to Embodiment 1 of the present invention.

An embodiment of a refrigeration cycle apparatus according to the present invention will be described hereinafter with reference to the drawings. FIG. 1 is a circuit diagram illustrating a refrigeration cycle apparatus 100 according to Embodiment 1 of the present invention. As illustrated in FIG. 1, the refrigeration cycle apparatus 100 is, for example, an air-conditioning apparatus for conditioning air in an indoor space, and includes an outdoor unit 22, and an indoor unit 21. The outdoor unit 22 is provided with a compressor 1, a flow passage switching device 2, an outdoor heat exchanger 3, an outdoor air-sending device 13, a first stationary valve 4, a second stationary valve 5, a low pressure detector 12, a liquid pipe temperature detector 9, an outdoor air temperature detector 8, a mode switch 23, and a controller 20. The indoor unit 21 is provided with two expansion units 10 and two indoor heat exchangers 11.

A refrigerant circuit is formed by connecting the compressor 1, the flow passage switching device 2, the outdoor heat exchanger 3, the first stationary valve 4, the two expansion units 10, the two indoor heat exchangers 11, and the second stationary valve 5 via pipes. The compressor 1 is configured to suck low-temperature and low-pressure refrigerant, compress the sucked refrigerant, to turn the refrigerant into a high-temperature and high-pressure state. The flow passage switching device 2 is configured to switch a flow direction of the refrigerant in the refrigerant circuit, and is, for example, a four-way valve.

The outdoor heat exchanger 3 is configured to exchange heat between outdoor air and the refrigerant, for example. The outdoor heat exchanger 3 operates as a condenser during the cooling operation, and operates as an evaporator during the heating operation. The outdoor air-sending device 13 is configured to circulate the outdoor air in the outdoor heat exchanger 3, and includes a fan motor 7, and a fan 6. The fan motor 7 is configured to drive the fan 6, and the fan 6 is an impeller being driven and rotated by the fan motor 7. The first stationary valve 4 is provided at a pipe connecting between the outdoor heat exchanger 3 and the expansion units 10, and the second stationary valve 5 is provided at a pipe connecting between the flow passage switching device 2 and the indoor heat exchangers 11. The first stationary valve 4 and the second stationary valve 5 block flow of the refrigerant between the outdoor unit 22 and the indoor unit 21 during maintenance.

The expansion unit 10 is a pressure-reducing valve or an expansion valve to reduce the pressure of the refrigerant to expand the refrigerant, and is, for example, an electronic expansion valve having a variable opening degree. The indoor heat exchanger 11 is configured to exchange heat between the indoor air and the refrigerant, for example. The indoor heat exchanger 11 operates as an evaporator during the cooling operation, and operates as a condenser during the heating operation. In Embodiment 1, the two expansion units 10 are connected in parallel, and the two indoor heat exchangers 11 are connected in parallel. However, one expansion unit 10 and one indoor heat exchanger 11 may be provided, or three or more expansion units 10 may be connected in parallel and three or more indoor heat exchangers 11 may be connected in parallel.

The low pressure detector 12 is provided on a suction side of the compressor 1, and detects a low pressure of the refrigerant flowing toward the suction side of the compressor 1. The liquid pipe temperature detector 9 is provided at the outdoor heat exchanger 3, and detects a liquid pipe temperature of the refrigerant flowing in the outdoor heat exchanger 3. The outdoor air temperature detector 8 detects a temperature of the outdoor air. The mode switch 23 shifts the mode to a silent mode. Here, the silent mode refers to a mode for restricting an upper limit value of the rotation speed of the outdoor air-sending device 13 to reduce the noise generated from the outdoor unit 22.

(Cooling Operation)

An operation mode of the refrigeration cycle apparatus 100 will be described. The operation modes of the refrigeration cycle apparatus 100 include a cooling operation, a heating operation and a defrosting operation. First, the cooling operation will be described. In the cooling operation, the refrigerant sucked into the compressor 1 is compressed by the compressor 1, and discharged from the compressor 1 in a high-temperature and high-pressure gas state. The refrigerant in the high-temperature and high-pressure gas state discharged from the compressor 1 passes through the flow passage switching device 2, flows into the outdoor heat exchanger 3 operating as a condenser, and, at the outdoor heat exchanger 3, exchanges heat with the outdoor air sent by the outdoor air-sending device 13, thereby being condensed and liquefied.

The refrigerant in a condensed liquid state passes through the first stationary valve 4, and then flows into each of the expansion units 10. At the expansion units 10, the refrigerant is expanded and the pressure of the refrigerant is reduced, resulting in the refrigerant entering a low-temperature and low-pressure two-phase gas-liquid state. Then, the refrigerant in the two-phase gas-liquid state flows into each of the indoor heat exchangers 11 operating as the evaporator, and, at the indoor heat exchangers 11, exchanges heat with the indoor air, thereby being evaporated and gasified. At that moment, the indoor air is cooled and thus the cooling operation is performed in a room. The evaporated refrigerant in the low-temperature and low-pressure gas state passes through the second stationary valve 5 and the flow passage switching device 2, and is sucked into the compressor 1.

(Heating Operation)

Next, the heating operation will be described. In the heating operation, the refrigerant sucked into the compressor 1 is compressed by the compressor 1, and discharged from the compressor 1 in a high-temperature and high-pressure gas state. The refrigerant in the high-temperature and high-pressure gas state discharged from the compressor 1 passes through the flow passage switching device 2 and the second stationary valve 5, flows into each of the indoor heat exchangers 11 operating as a condenser, and, at the indoor heat exchangers 11, exchanges heat with the indoor air, thereby being condensed and liquefied. At that moment, the indoor air is heated and thus the heating operation is performed in the room.

The refrigerant in a condensed liquid state flows into each of the expansion units 10, and, at the expansion units 10, the refrigerant is expanded and the pressure of the refrigerant is reduced to have a low-temperature and low-pressure two-phase gas-liquid state. Then, the refrigerant in the two-phase gas-liquid state passes through the first stationary valve 4, and then flows into the outdoor heat exchanger 3 operating as an evaporator, and at the outdoor heat exchanger 3, exchanges heat with the outdoor air sent by the outdoor air-sending device 13, thereby being evaporated and gasified. The evaporated refrigerant in the low-temperature and low-pressure gas state passes through the flow passage switching device 2, and is sucked into the compressor 1.

(Defrosting Operation)

Next, the defrosting operation will be described. The defrosting operation is an operation for removing frost deposited on the outdoor heat exchanger 3 during the heating operation. In the defrosting operation, the refrigerant sucked into the compressor 1 is compressed by the compressor 1 and discharged from the compressor 1 in a high-temperature and high-pressure gas state. The refrigerant in the high-temperature and high-pressure gas state discharged from the compressor 1 passes through the flow passage switching device 2, and flows into the outdoor heat exchanger 3. At this time, the frost deposited on the outdoor heat exchanger 3 is melted.

At the outdoor heat exchanger 3, the refrigerant exchanges heat with the outdoor air sent by the outdoor air-sending device 13, thereby being condensed and liquefied. The refrigerant in the condensed liquid state passes through the first stationary valve 4, and flows into each of the expansion units 10. At the expansion units 10, the refrigerant is expanded and the pressure of the refrigerant is reduced to have a low-temperature and low-pressure two-phase gas-liquid state. The refrigerant in the two-phase gas-liquid state flows into each of the indoor heat exchangers 11 operating as an evaporator, and at the indoor heat exchangers 11, exchanges heat with the indoor air, thereby being evaporated and gasified. The evaporated refrigerant in the low-temperature and low-pressure gas state passes through the second stationary valve 5 and the flow passage switching device 2, and is sucked into the compressor 1.

The controller 20 includes a microcomputer, for example, and controls a capacity of the compressor 1, the opening degree of the expansion unit 10, and the rotation speed of the outdoor air-sending device 13 based on a detection value obtained from each sensor. The operation modes of the controller 20 include a normal mode and a silent mode. The normal mode refers to a mode for performing a normal operation, and the silent mode refers to a mode for restricting the maximum rotation speed of the outdoor air-sending device 13 to suppress the noise further than that in the normal mode. The controller 20 includes a dew-point temperature prediction unit 24, an evaporating temperature prediction unit 25, a mode execution unit 26, and an air-sending control unit 27. The dew-point temperature prediction unit 24 predicts a dew-point temperature to be observed after elapse of a preset time based on an outdoor air temperature detected by the outdoor air temperature detector 8. The dew-point temperature prediction unit 24 predicts the dew-point temperature to be observed after elapse of preset time based on the outdoor air temperature assuming the humidity as a predetermined value.

Figure 2:
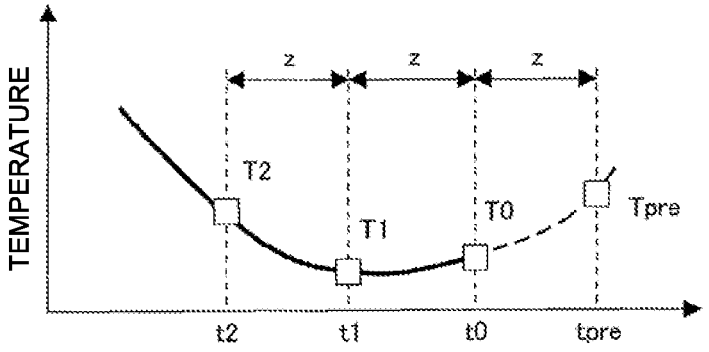
FIG. 2 is a graph showing the change over time in liquid pipe temperature in Embodiment 1 of the present invention.

FIG. 2 is a graph showing the change over time in the liquid pipe temperature in Embodiment 1 of the present invention. In FIG. 2, the vertical axis represents the evaporating temperature, and the horizontal axis represents the time. The evaporating temperature prediction unit 25 is configured to predict the evaporating temperature to be observed after elapse of a preset time of the refrigerant flowing in the outdoor heat exchanger 3 during the heating operation. The evaporating temperature prediction unit 25 predicts the evaporating temperature to be observed after elapse of a preset time based on, for example, the liquid pipe temperature detected by the liquid pipe temperature detector 9. As shown in FIG. 2, the liquid pipe temperature is changed along with the elapse of time. The liquid pipe temperatures detected for each preset time z by the liquid pipe temperature detector 9 are sampled, and the evaporating temperature prediction unit 25 predicts a liquid pipe temperature to be observed after elapse of a preset time z based on the inclination of the graph at the time when a liquid pipe temperature T2 before two z time periods, a liquid pipe temperature T1 before a z time period, and a liquid pipe temperature T0 at the current time are plotted. The evaporating temperature prediction unit 25 predicts the liquid pipe temperature to be observed after elapse of the preset time z as an evaporating temperature.

The mode execution unit 26 is configured to cause the refrigeration cycle apparatus 100 to operate in the silent mode. The mode execution unit 26 causes the refrigeration cycle apparatus 100 to operate in the silent mode when the mode switch 23 is pushed during the operation of the compressor 1 and the heating operation.

Figure 3:
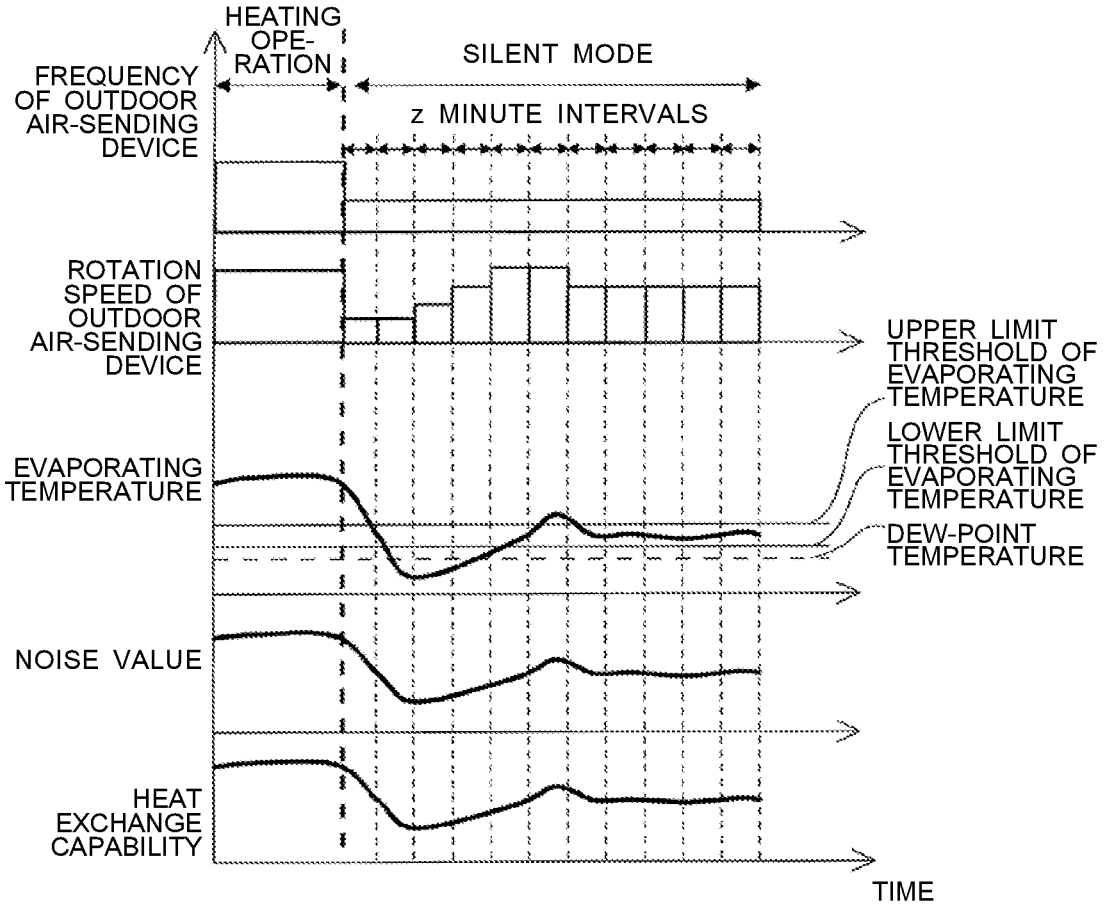
FIG. 3 is a timing chart showing an operation of the refrigeration cycle apparatus 100 according to Embodiment 1 of the present invention.

FIG. 3 is a timing chart showing an operation of the refrigeration cycle apparatus 100 according to Embodiment 1 of the present invention. As shown in FIG. 3, when the mode execution unit 26 causes the refrigeration cycle apparatus 100 to operate in the silent mode, the controller 20 reduces an operation frequency of the outdoor air-sending device 13 to a predetermined value. Then, when the mode execution unit 26 causes the refrigeration cycle apparatus to operate in the silent mode, the air-sending control unit 27 is configured to change the rotation speed of the outdoor air-sending device 13 in such a manner that the evaporating temperature predicted by the evaporating temperature prediction unit 25 exceeds the dew-point temperature predicted by the dew-point temperature prediction unit 24.

More specifically, the air-sending control unit 27 is configured to change the rotation speed of the outdoor air-sending device 13 in such a manner that the evaporating temperature falls in a range between a lower limit threshold of the evaporating temperature and an upper limit threshold of the evaporating temperature, the lower limit threshold of the evaporating temperature being obtained by adding a preset lower limit value to the dew-point temperature, and the upper limit threshold of the evaporating temperature being obtained by adding a preset upper limit value to the dew-point temperature. Thus, the air-sending control unit 27 secures margins for the adjustment range so that the evaporating temperature exceeds the lower limit threshold of the evaporating temperature that is higher than the dew-point temperature, thereby capable of reliably preventing the evaporating temperature from being below the dew-point temperature.

By keeping the evaporating temperature below the upper limit threshold of the evaporating temperature, the air-sending control unit 27 also prevents the rotation speed of the outdoor air-sending device 13 from being excessively increased. When the mode execution unit 26 causes the refrigeration cycle apparatus to operate in the silent mode, the air-sending control unit 27 first reduces the rotation speed of the outdoor air-sending device 13 to an initial silent rotation speed Fan0. Then, the air-sending control unit 27 changes the rotation speed of the outdoor air-sending device 13 based on the dew-point temperature and the evaporating temperature.

At that moment, the air-sending control unit 27 changes the rotation speed of the outdoor air-sending device 13 at z minute intervals. An initial value of an amount of variation ΔFan in the rotation speed is set to zero, the air-sending control unit 27 determines ΔFan based on the evaporating temperature, and the determined ΔFan is added to the rotation speed before z minutes. When the evaporating temperature is lower than the lower limit threshold for the evaporating temperature, the amount of variation ΔFan becomes $+\alpha$. When the evaporating temperature is higher than the upper limit threshold for the evaporating temperature, the amount of variation ΔFan becomes $-\alpha$. When the evaporating temperature falls in the range between the lower limit threshold of the evaporating temperature and the upper limit threshold of the evaporating temperature, the amount of variation ΔFan in the rotation speed converges at zero.

As shown in FIG. 3, when the refrigeration cycle apparatus 100 shifts to the silent mode during the heating operation, the operation frequency of the outdoor air-sending device 13 is reduced, the rotation speed of the outdoor air-sending device 13 is reduced, to an initial silent rotation speed Fan0. As a result, the evaporating temperature is decreased. A noise value is decreased, and heat exchange capability is also slightly decreased. The air-sending control unit 27 updates the rotation speed of the outdoor air-sending device 13 every z minutes, and the rotation speed is obtained by the expression: Fan(n)=Fan(n−1)+ΔFan. At this time, when the evaporating temperature is lower than the lower limit threshold of the evaporating temperature, the air-sending control unit 27 uses Fan(n)=Fan(n−1)+α to suppress the reduction in the heat exchange capability. On the other hand, when the evaporating temperature is higher than the upper limit threshold of the evaporating temperature, the air-sending control unit 27 uses Fan(n)=Fan(n−1)−α to suppress the increase in the noise value. In this way, the refrigeration cycle apparatus 100 suppresses the noise while maintaining the heat exchange capability. Accordingly, the refrigeration cycle apparatus 100 can suppress the generation of the noise without shifting to the defrosting operation.

Figure 4:
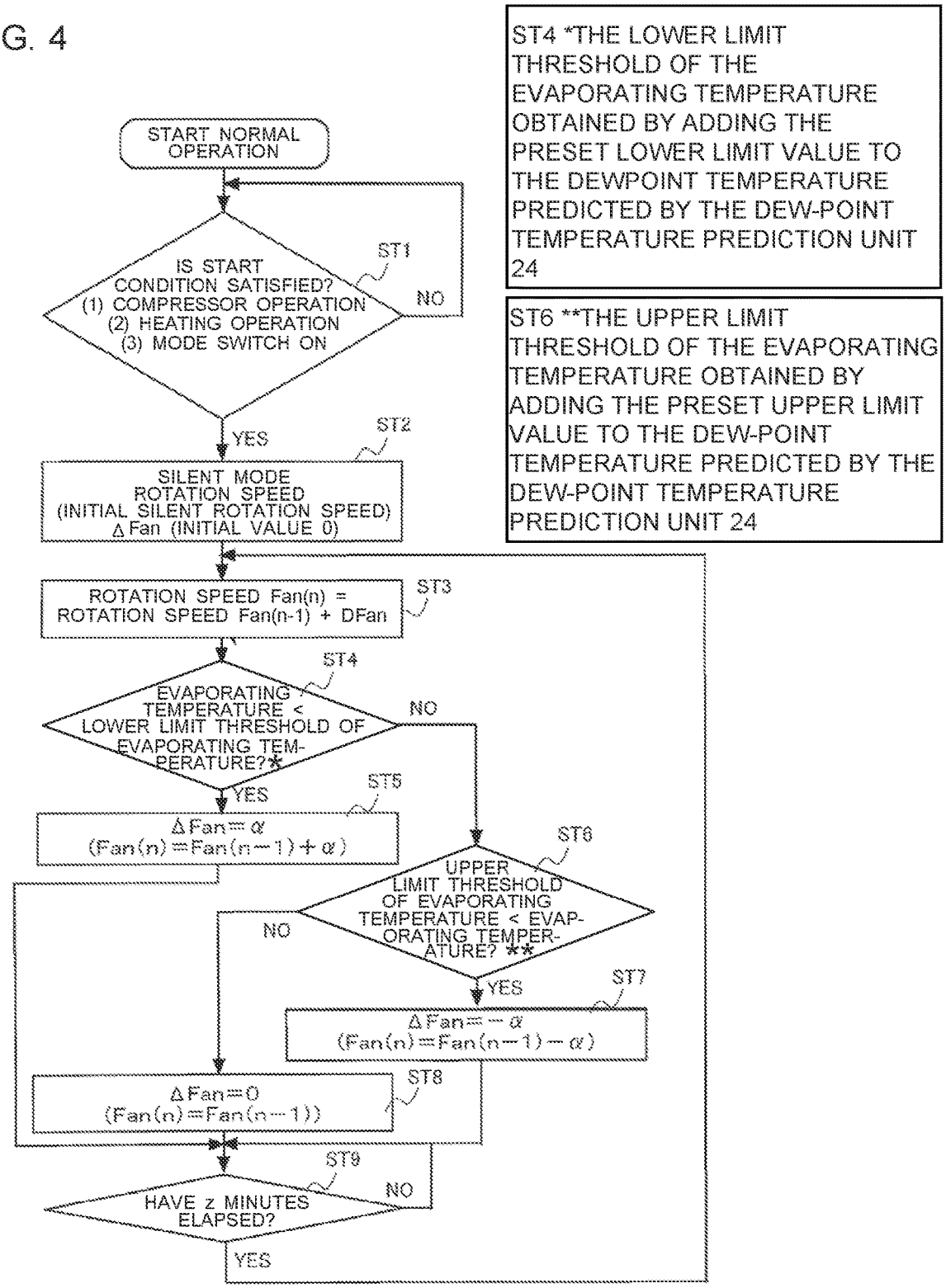
FIG. 4 is a flowchart illustrating an operation of the refrigeration cycle apparatus 100 according to Embodiment 1 of the present invention.

FIG. 4 is a flowchart illustrating an operation of the refrigeration cycle apparatus 100 according to Embodiment 1 of the present invention. Next, the operation of the controller 20 of the refrigeration cycle apparatus 100 will be described. As illustrated in FIG. 4, when the mode switch 23 is pushed (Yes in step ST1) during the operation of the compressor 1 and the heating operation, the mode execution unit 26 causes refrigeration cycle apparatus to operate in the silent mode (step ST2). At that moment, the air-sending control unit 27 sets the rotation speed of the outdoor air-sending device 13 to the initial silent rotation speed Fan0, and ΔFan is set to zero. Then, the air-sending control unit 27 changes the rotation speed of the outdoor air-sending device 13 at z minute intervals. More specifically, the air-sending control unit 27 changes the rotation speed of the outdoor air-sending device 13 using the expression: Fan(n)=Fan(n−1)+ΔFan (step ST3).

When the evaporating temperature is lower than the lower limit threshold of the evaporating temperature obtained by adding the preset lower limit value to the dew-point temperature predicted by the dew-point temperature prediction unit 24 (Yes in step ST4), ΔFan becomes +α, and Fan(n)=Fan(n−1)+α is applied (step ST5). Then, the process proceeds to step ST9. When the evaporating temperature is higher than the upper limit threshold of the evaporating temperature obtained by adding the preset upper limit value to the dew-point temperature predicted by the dew-point temperature prediction unit 24 (Yes in step ST6), ΔFan becomes −α, and Fan(n)=Fan(n−1)−α is applied (step ST7). Then, the process proceeds to step ST9. When the evaporating temperature is equal to or higher than the lower limit threshold of the evaporating temperature and equal to or lower than the upper limit threshold of the evaporating temperature (No in step ST6), ΔFan becomes zero, and Fan(n) is equal to Fan(n−1) (step ST8).

In step ST9, it is determined whether z minutes have elapsed. Step ST9 is repeated until z minutes have elapsed. When z minutes have elapsed (Yes in step ST9), the process returns to step ST3.

According to Embodiment 1, the air-sending control unit 27 changes the rotation speed of the outdoor air-sending device 13 in such a manner that the predicted evaporating temperature to be observed after elapse of the preset time exceeds the predicted dew-point temperature to be observed after elapse of the preset time based on the outdoor air temperature. Thus, the dew-point temperature prediction unit 24 predicts the dew-point temperature to be observed after elapse of the preset time that changes according to the outdoor air temperature, and the air-sending control unit 27 changes the rotation speed of the outdoor air-sending device 13 according to the predicted dew-point temperature. Therefore, even if the dew-point temperature to be observed after elapse of the preset time is changed, the frost can be prevented from being deposited on the outdoor heat exchanger 3. Accordingly, it is possible to, by the refrigeration cycle apparatus 100, prevent frequent shifting to the defrosting operation.

When the mode execution unit 26 cause the refrigeration cycle apparatus to operate in the silent mode, the air-sending control unit 27 changes the rotation speed of the outdoor air-sending device 13 in such a manner that the evaporating temperature exceeds the dew-point temperature. In Embodiment 1, the refrigeration cycle apparatus 100 can also prevent frequent shifting to the defrosting operation in the silent mode, and the noise can be further reduced. That is, the refrigeration cycle apparatus 100 can reduce the noise generated by the outdoor air-sending device 13 while preventing frequent shifting to the defrosting operation.

There has been known a refrigeration cycle apparatus that has a silent mode for restricting an upper limit value of a rotation speed of an outdoor air-sending device as a technique for reducing the noise generated from an outdoor unit. Note that the silent mode includes a mode for restricting the upper limit value of the operation frequency of the outdoor air-sending device. In the conventional air-conditioning device, when the mode is shifted to the silent mode during the heating operation, the rotation speed is not changed after the rotation speed of the outdoor air-sending device is reduced to a predetermined value. Thus, an air amount sent by the outdoor air-sending device is reduced, and the evaporating temperature of the refrigerant flowing in the outdoor heat exchanger is decreased. Therefore, when the evaporating temperature is lower than the dew-point temperature determined based on the outdoor air temperature, the frost is attached to the outdoor heat exchanger. Here, the dew-point temperature is changed according to a dry-bulb temperature and a wet-bulb temperature in the environment in which the outdoor unit is installed.

When the growth of frost continues, the frost serves to provide draft resistance at an air passage, so that an amount of the outdoor air is reduced. When the amount of the outdoor air sent by the outdoor air-sending device is reduced, the evaporating temperature of the outdoor heat exchanger is also reduced. When the evaporating temperature is lower than the predetermined value, the reduction in the heat exchange capability is avoided, and a hot gas defrosting operation is performed. However, the noise is generated when the operation is switched to the hot gas defrosting operation. Thus, when the silent mode is used during the heating operation, there is a problem in that the noise is generated due to frequent shifting to the defrosting operation. When the outdoor air temperature is equal to or lower than 0 degrees C., the evaporating temperature becomes equal to or lower than 0 degrees C. so that the outdoor air-sending device is constantly maintained at a high rotation speed, decreasing the effect of reducing the noise in the silent mode.

By contrast, in Embodiment 1, the rotation speed of the outdoor air-sending device 13 is changed according to the dew-point temperature that is changed based on the temperature of the outdoor air. Thus, even if the dew-point temperature is changed, the frost is prevented from being deposited on the outdoor heat exchanger 3.

Note that the air-sending control unit 27 may be configured to change the rotation speed of the outdoor air-sending device 13 in such a manner that the rotation speed of the outdoor air-sending device 13 does not exceed the upper limit threshold of the rotation speed. In this way, the air-sending control unit 27 can prevent the rotation speed of the outdoor air-sending device 13 from being excessively increased, and suppress the generation of the noise. Thus, reducing noise can be given higher priority than is to avoiding the defrosting operation.

Note that the controller 20 may be configured to further include a compression control unit (not illustrated) for changing the operation frequency of the compressor 1 in such a manner that the operation frequency of the compressor 1 does not exceed the upper limit threshold of the frequency. Thus, the defrosting operation can be avoided even when the air-sending control unit 27 changes the rotation speed of the outdoor air-sending device 13 in such a manner that the rotation speed of the outdoor air-sending device 13 does not exceed the upper limit value of the rotation speed to place priority to reducing the noise.

The controller 20 further include a threshold correction unit (not illustrated) for adding a correction value to the preset lower limit value and the preset upper limit value, in a case where the defrosting operation starts when the air-sending control unit 27 changes the rotation speed of the outdoor air-sending device 13. In a case where the defrosting operation starts when the air-sending control unit 27 changes the rotation speed of the outdoor air-sending device 13, the controller 20 estimates that a predetermined humidity used when the dew-point temperature prediction unit 24 predicts the dew-point temperature is higher than the actual humidity. In this case, the correction value is added to the preset lower limit value and the preset upper limit value, and thereby the defrosting operation can be avoided. The correction value is determined by the feedback control. The threshold correction unit ends the correction of the preset lower limit value and the preset upper limit value when the silent mode has been finished, the refrigeration cycle apparatus 100 has been stopped, or a predetermined time has elapsed.

In Embodiment 1, an example is described in which the evaporating temperature prediction unit 25 predicts the evaporating temperature based on the liquid pipe temperature detected by the liquid pipe temperature detector 9. Without limitation to this example, the evaporating temperature prediction unit 25 may be configured to predict the evaporating temperature based on the low pressure detected by the low pressure detector 12. The evaporating temperature prediction unit 25 predicts a converted saturation temperature value of the low pressure as an evaporating temperature. In this way, the liquid pipe temperature detector 9 can be omitted.

In Embodiment 1, an example is described in which the mode switch 23 is adopted as a switch for shifting to the silent mode. Without limitation to this example, an end user or a business person or the like performs communication operations using a remote controller, a relay, or the other device, to shift the mode to the silent mode. When the controller 20 is configured as an indoor control circuit board or an outdoor control circuit board, a switch mounted on the indoor control circuit board or the outdoor control circuit board may be operated so that the mode is shifted to the silent mode. Furthermore, the refrigeration cycle apparatus 100 may have an auto mode function of automatically shifting the mode to the silent mode according to a time zone, or an outdoor air temperature.

REFERENCE SIGNS LIST

1 Compressor 2 Flow passage switching device 3 Outdoor heat exchanger 4 First stationary valve 5 Secondary stationary valve 6 Fan 7 Fan motor 8 Outdoor air temperature detector 9 Liquid pipe temperature detector 10 Expansion unit 11 Indoor heat exchanger 12 Lower pressure detector 13 Outdoor air-sending device 20 Controller 21 Indoor unit 22 Outdoor unit 23 Mode switch 24 Dew-point temperature prediction unit 25 Evaporating temperature prediction unit 26 Mode execution unit 27 Air-sending control unit 100 Refrigeration cycle device

The invention claimed is:

1. A refrigeration cycle apparatus, comprising:

a refrigerant circuit that is formed by connecting a compressor, a four-way valve, an outdoor heat exchanger, an expansion valve, and an indoor heat exchanger via pipes, and through which refrigerant flows;

an outdoor fan configured to blow outdoor air to the outdoor heat exchanger;

an outdoor air temperature sensor configured to detect a temperature of the outdoor air; and a controller configured to control an operation of the outdoor fan, and configured to cause the refrigeration cycle apparatus to operate in a normal mode for performing a normal operation, and a silent mode for restricting a maximum rotation speed of the outdoor fan such that the maximum rotation speed is smaller than in the normal mode to suppress a noise, the controller being further configured to:

predict a dew-point temperature after elapse of a preset time, based on an outdoor air temperature detected by the outdoor air temperature sensor and a predetermined humidity value;

predict an evaporating temperature after elapse of the preset time of the refrigerant flowing in the outdoor heat exchanger during a heating operation;

change a rotation speed of the outdoor fan in such a manner that the evaporating temperature predicted by the controller exceeds the dew-point temperature predicted by the controller, and cause the refrigeration cycle apparatus to operate in the silent mode during the heating operation, wherein the controller is configured to change the rotation speed of the outdoor fan in such a manner that the evaporating temperature exceeds the dew-point temperature, when the controller causes the refrigeration cycle apparatus to operate in the silent mode.

2. The refrigeration cycle apparatus of claim 1, wherein the controller is configured to change the rotation speed of the outdoor fan in such a manner that the evaporating temperature exceeds a lower limit threshold of the evaporating temperature obtained by adding a preset lower limit value to the dew-point temperature.

3. The refrigeration cycle apparatus of claim 2, wherein the controller is configured to change the rotation speed of the outdoor fan in such a manner that the evaporating temperature is below an upper limit threshold of the evaporating temperature obtained by adding a preset upper limit value to the dew-point temperature.

4. The refrigeration cycle apparatus of claim 3, wherein the controller is further configured to add a correction value to the preset lower limit value and the preset upper limit value in a case where the defrosting operation starts when the controller changes the rotation speed of the outdoor fan.

5. The refrigeration cycle apparatus of claim 1, wherein the controller is configured to, when the controller causes the refrigeration cycle apparatus to operate in the silent mode, change the rotation speed of the outdoor fan based on the dew-point temperature and the evaporating temperature after lowering the rotation speed of the outdoor fan is reduced to an initial silent rotation speed.

6. The refrigeration cycle apparatus of claim 1, wherein the controller is configured to change the rotation speed of the outdoor fan in such a manner that the rotation speed of the outdoor fan does not exceed an upper limit threshold of the rotation speed.

7. The refrigeration cycle apparatus of claim 1, wherein the controller is further configured to change an operation frequency of the compressor in such a manner that the operation frequency of the compressor does not exceed an upper limit threshold of the frequency.

8. A refrigeration cycle apparatus, comprising:

a refrigerant circuit that is formed by connecting a compressor, a four-way valve, an outdoor heat exchanger, an expansion valve, and an indoor heat exchanger via pipes, and through which refrigerant flows;

an outdoor fan configured to blow outdoor air to the outdoor heat exchanger;

an outdoor air temperature sensor configured to detect a temperature of the outdoor air;

a controller configured to control an operation of the outdoor fan, and a liquid pipe temperature detector configured to detect a liquid pipe temperature of refrigerant flowing in the outdoor heat exchanger, the controller being further configured to:

predict a dew-point temperature after elapse of a preset time, based on an outdoor air temperature detected by the outdoor air temperature sensor and a predetermined humidity value;

predict an evaporating temperature after elapse of the preset time of the refrigerant flowing in the outdoor heat exchanger during a heating operation; and change a rotation speed of the outdoor fan in such a manner that the evaporating temperature predicted by the controller exceeds the dew-point temperature predicted by the controller, wherein the controller is configured to predict the evaporating temperature based on the liquid pipe temperature detected by the liquid pipe temperature detector.

9. The refrigeration cycle apparatus of claim 1, further comprising:

a low pressure detector configured to detect a low pressure of the refrigerant flowing at a suction side of the compressor, wherein the controller is configured to predict the evaporating temperature based on the low pressure detected by the low pressure detector.

* * * * *